US012378867B2

(12) United States Patent
Frost et al.

(10) Patent No.: US 12,378,867 B2
(45) Date of Patent: Aug. 5, 2025

(54) DOWNHOLE LIQUID/GAS SEPARATION SYSTEM WITH GAS DISCHARGE TOOL

(71) Applicant: ODESSA SEPARATOR, INC., Odessa, TX (US)

(72) Inventors: Cavin Bert Frost, Odessa, TX (US); Daniel L Culbertson, Odessa, TX (US); Gustavo A. Gonzalez-Cabrera, Midland, TX (US)

(73) Assignee: ODESSA SEPARATOR, INC., Odessa, TX (US)

( * ) Notice: Subject to any disclaimer, the term of this patent is extended or adjusted under 35 U.S.C. 154(b) by 0 days.

(21) Appl. No.: 17/812,509

(22) Filed: Jul. 14, 2022

(65) Prior Publication Data

US 2023/0014861 A1 Jan. 19, 2023

Related U.S. Application Data

(60) Provisional application No. 63/223,165, filed on Jul. 19, 2021.

(51) Int. Cl.
*E21B 43/38* (2006.01)
*E21B 43/12* (2006.01)

(52) U.S. Cl.
CPC ..... *E21B 43/38* (2013.01); *E21B 43/121* (2013.01)

(58) Field of Classification Search
CPC ..... E21B 43/34; E21B 43/35; E21B 43/38; E21B 43/12; E21B 43/121
See application file for complete search history.

(56) References Cited

U.S. PATENT DOCUMENTS 1,665,540 A * 4/1928 Green ..... E21B 43/12 166/105.5
2,349,164 A * 5/1944 Gilbert ..... F04F 1/06 166/105.5
2,652,130 A * 9/1953 Ferguson ..... E21B 43/38 137/118.06
2,883,940 A * 4/1959 Gibson ..... E21B 43/38 166/105.5
3,887,342 A * 6/1975 Bunnelle ..... B01D 19/0057 417/313
4,074,763 A 2/1978 Stevens
4,088,459 A 5/1978 Tuzson
4,231,767 A 11/1980 Acker
4,275,790 A * 6/1981 Abercrombie ..... E21B 43/121 166/372

(Continued)

*Primary Examiner* — Yanick A Akaragwe
(74) *Attorney, Agent, or Firm* — Smith IP Services, P.C.

(57) ABSTRACT

A gas separation system can include a gas separator tool, and a gas discharge tool including an inner flow passage formed through a tube and configured to convey separated liquids, and discharge ports configured to discharge well fluids upwardly into an area surrounding the tube. A method of separating gas from liquids of well fluids produced from a subterranean well can include connecting a gas separator tool and a gas discharge tool to a production tubing string, positioning the gas separator tool and the gas discharge tool in the well, so that the well fluids are produced into the gas separator tool, receiving the well fluids from the gas separator tool into the gas discharge tool, and discharging the well fluids from the gas discharge tool into a radially enlarged section of an annulus surrounding the gas discharge tool.

20 Claims, 4 Drawing Sheets

(56) References Cited

U.S. PATENT DOCUMENTS

| | | | | |
|---|---|---|---|---|
| 4,481,020 | A | 11/1984 | Lee et al. | |
| 5,154,588 | A | 10/1992 | Freet et al. | |
| 5,411,088 | A | 5/1995 | Leblanc et al. | |
| 5,482,117 | A | 1/1996 | Kolpak et al. | |
| 7,104,321 | B2 | 9/2006 | Carruth | |
| 8,950,491 | B2 | 2/2015 | Frost | |
| 9,670,758 | B2 * | 6/2017 | Wilson | F04B 47/06 |
| 10,415,360 | B2 | 9/2019 | Culbertson et al. | |
| 10,724,356 | B2 | 7/2020 | Mccoy | |
| 10,808,516 | B2 | 10/2020 | Brown et al. | |
| 10,968,729 | B2 | 4/2021 | Sylvester | |
| 11,008,847 | B2 | 5/2021 | Dyck et al. | |
| 11,028,682 | B1 | 6/2021 | Zhang | |
| 11,098,571 | B2 | 8/2021 | Raglin et al. | |
| 2020/0208506 | A1 | 7/2020 | Frost et al. | |
| 2020/0217187 | A1 | 7/2020 | Wang et al. | |

* cited by examiner

DOWNHOLE LIQUID/GAS SEPARATION SYSTEM WITH GAS DISCHARGE TOOL

BACKGROUND

This disclosure relates generally to equipment utilized and operations performed in conjunction with a subterranean well and, in an example described below, more particularly provides a downhole gas/liquid separation system with a gas discharge tool.

Oil and gas operators face many obstacles in their work to produce valuable products to the surface. A common problem is the need to separate gas from liquids. Pumps work well in moving liquids but cannot operate efficiently when gas is introduced.

Many variations of gas separators exist to solve this issue. In one example, a gas separator takes in fluid which is routed downward toward a dip tube intake. This change in direction of the flow of fluid allows time for fluid velocity to diminish which causes entrained gas bubbles to break out of the fluid. The gas, being lighter than fluid and air, rises naturally up the well casing and is produced to the surface.

It will be appreciated that improvements are continually needed in the art of downhole gas/liquid separation. The present specification provides such improvements, which may be used with a variety of different types of gas separators and well systems.

DETAILED DESCRIPTION

Figure 1:
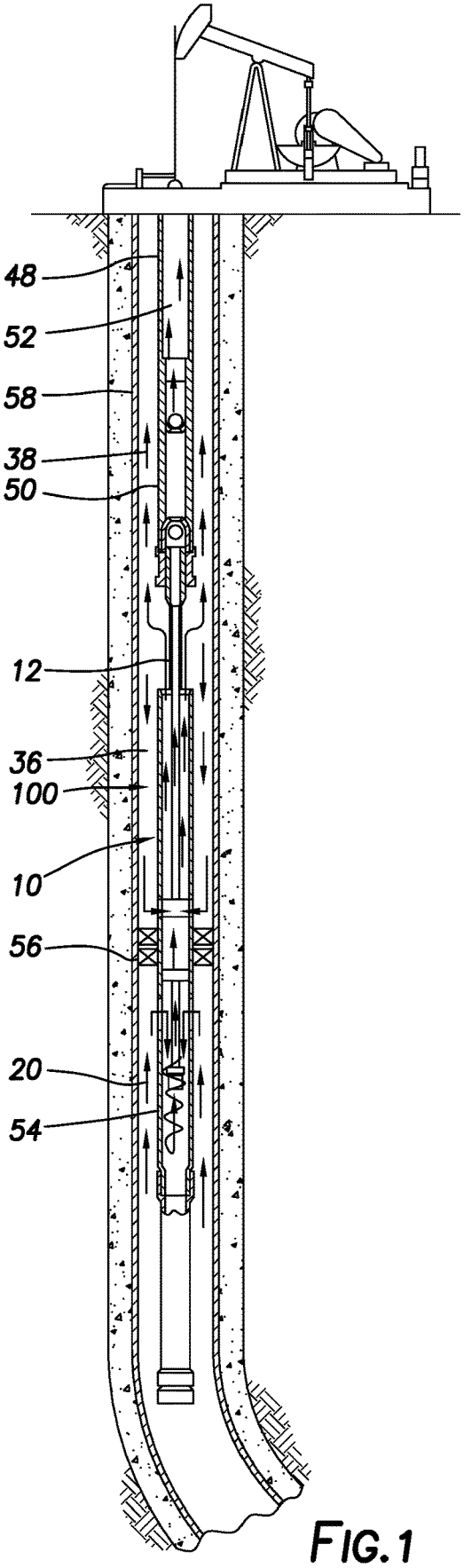
FIGS. 1-1C are representative partially cross-sectional views of an example of a well system and associated method which can embody principles of this disclosure.
Figure 1A:
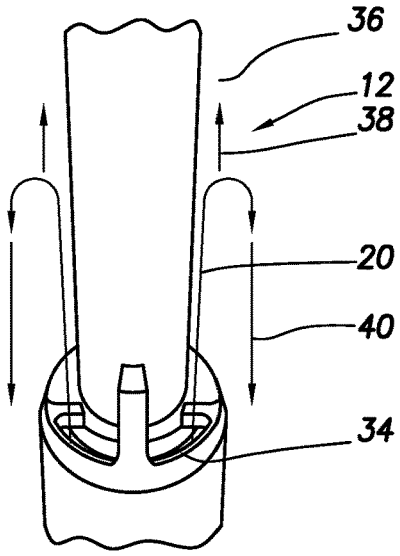
Figure 1B:
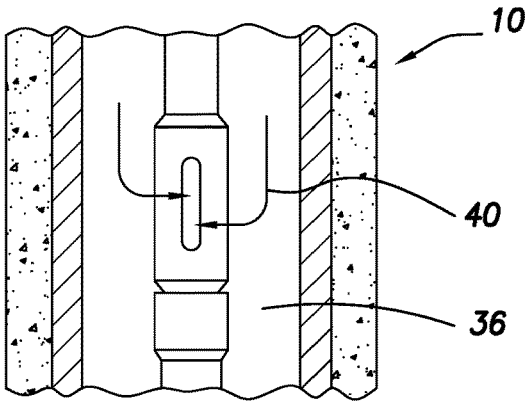
Figure 1C:
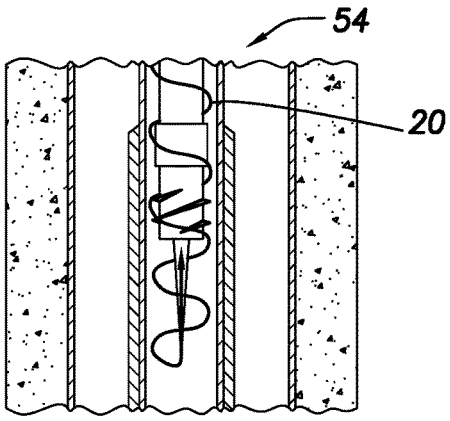

Representatively illustrated in FIGS. 1-1C is a gas separation system 100 for use with a subterranean well, and an associated method, which can embody principles of this disclosure. However, it should be clearly understood that the system 100 and method are merely one example of an application of the principles of this disclosure in practice, and a wide variety of other examples are possible. Therefore, the scope of this disclosure is not limited at all to the details of the system 100 and method described herein and/or depicted in the drawings.

In the FIG. 1 system 100, a gas discharge tool 12 is connected at a distal end of a production tubing string 48 in a well. The gas discharge tool 12 is connected between a gas separator tool 10 and a downhole pump 50. In this example, the downhole pump 50 is operated by a reciprocating rod string 52, but in other examples different types of pumps may be used (such as, an electric submersible pump), or no downhole pump may be used.

As depicted in FIG. 1, a vortex separator tool 54 is connected below the gas separator tool 10. In this example, produced well fluids 20 are received into the vortex separator tool 54, which produces a vortex in the fluid flow, thereby causing any sand or debris in the fluids to separate from the fluids due to centripetal force (see FIG. 1C). However, use of a vortex separator is not necessary in keeping with the principles of this disclosure.

A packer 56 is set in the well between the vortex separator tool 54 and the gas separator tool 10. The well fluids 20 flow from the vortex separator tool 54, through the packer 56 and then into an annulus 22 formed radially between an inner tube 24 and an outer housing 26 of the gas separator tool 10 (see FIG. 2). The well fluids 20 flow upwardly through the annulus 22 to the gas discharge tool 12.

As depicted in FIG. 1A, the well fluids 20 exit the gas discharge tool 12 via relatively large upwardly facing slotted ports 34, at which point the well fluids 20 enter an annulus 36 formed radially between the production tubing string 48 and the wellbore or casing 58 surrounding the production tubing string.

In the annulus 36, gas 38 separates from liquids 40 of the well fluids 20. The less dense gas 38 rises to the surface via the annulus 36. The more dense liquids 40 descend in the annulus 36.

The liquids 40 accumulate at a distal end of the annulus 36 and flow into the inner tube 24 of the gas separator tool 10 (see FIG. 1B). The liquids 40 can then flow to the surface via an inner flow passage 14 (see FIG. 2) extending through the gas separator tool 10, the gas discharge tool 12 and the production tubing string 48.

In some prior gas separators, turbulence occurs as high velocity gas exits through openings in a side wall of the gas separator. Gas must make a 90 degree turn as it exits out the openings (typically slots or round holes). Another 90-degree turn takes place as the gas changes direction again to pass upward. This interference slows the flow of gas up the casing.

Figure 2:
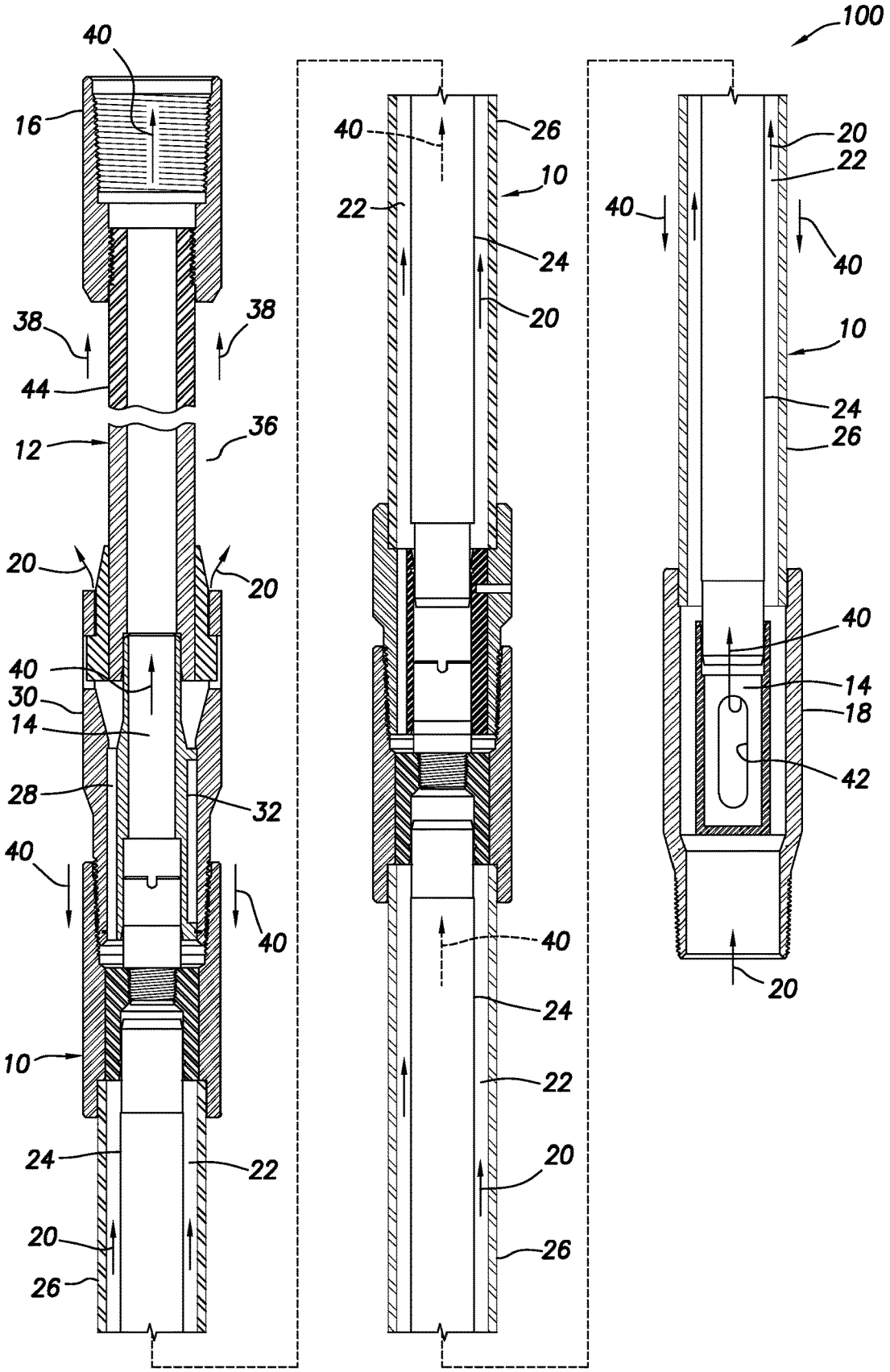
FIG. 2 is a representative cross-sectional view of an example of an upper portion of a gas separation system that may be used with the FIG. 1 system and method.

In contrast, in an example described herein and depicted in the drawings, at a connection point where a lower outer housing 30 and an upper tube 44 of the gas discharge tool 12 are joined, upward-facing, slotted discharge ports 34 are integrated into the connection (see FIG. 2). This means the gas 38 avoids the circuitous pathway common in some gas separation tools. The gas 38 is free to rise unrestricted in a more uniform, linear motion.

Due to the enhanced flow dynamics gained through the use of upward facing discharge ports 34, and to maintain a direct straight-line path for gas 38 to move, the upper tube 44 of the gas discharge tool 12 is of a reduced diameter compared to typical gas separator body designs. This increases the available volume within the annulus 36 between the casing 58 and the upper tube 44 of the gas discharge tool 12. This additional space also serves to facilitate improved gas 38 flow.

The drawings depict the gas discharge tool in a below-packer application. The upward-facing slotted port opening configuration may also be integrated with other gas separator types and sizes in other examples, whether or not positioned below-packer.

Referring specifically now to FIG. 2, a cross-sectional view of an example of an upper portion of the gas separation system 100 is representatively illustrated. The FIG. 2 gas separation system 100 may be used with the FIG. 1 system and method, or it may be used with other systems or methods.

In FIG. 2, the gas separator tool 10 and the gas discharge tool 12 are depicted in an assembled configuration. An inner flow passage 14 extends longitudinally in the gas separator tool 10 and the gas discharge tool 12, from an upper connector 16 to a lower connector 18.

In the FIG. 1 example, the production tubing string 48 is connected to the upper connector 16 and the packer 56 is connected to the lower connector 18. However, other configurations may be used in other examples, and the scope of this disclosure is not limited to use of the gas separator 10 and gas discharge tool 12 with the FIG. 1 system.

Well fluids 20 enter the lower connector 18 (from the vortex separator tool 54 and packer 56 in the FIG. 1 system) and flow upwardly through an annulus 22 formed radially between respective inner tubes 24 and outer housings 26 of the gas separator tool 10. The well fluids 20 flow from the annulus 22 to another annulus 28 formed radially between an outer housing 30 and an inner tube 32 of the gas discharge tool 12. The well fluids 20 are discharged from the gas discharge tool 12 into the surrounding annulus 36 via upwardly-facing discharge ports 34.

As described above, in the annulus 36 the well fluids 20 separate into gas 38 and liquids 40. The gas 38 rises in the annulus 36 to the surface. The liquids 40 descend to the distal end of the annulus 36, where the liquids can flow via openings 42 into the flow passage 14 in the inner tubes 24. The liquids 40 can then flow to the surface via the flow passage 14 extending through the production tubing string 48.

Figure 3:
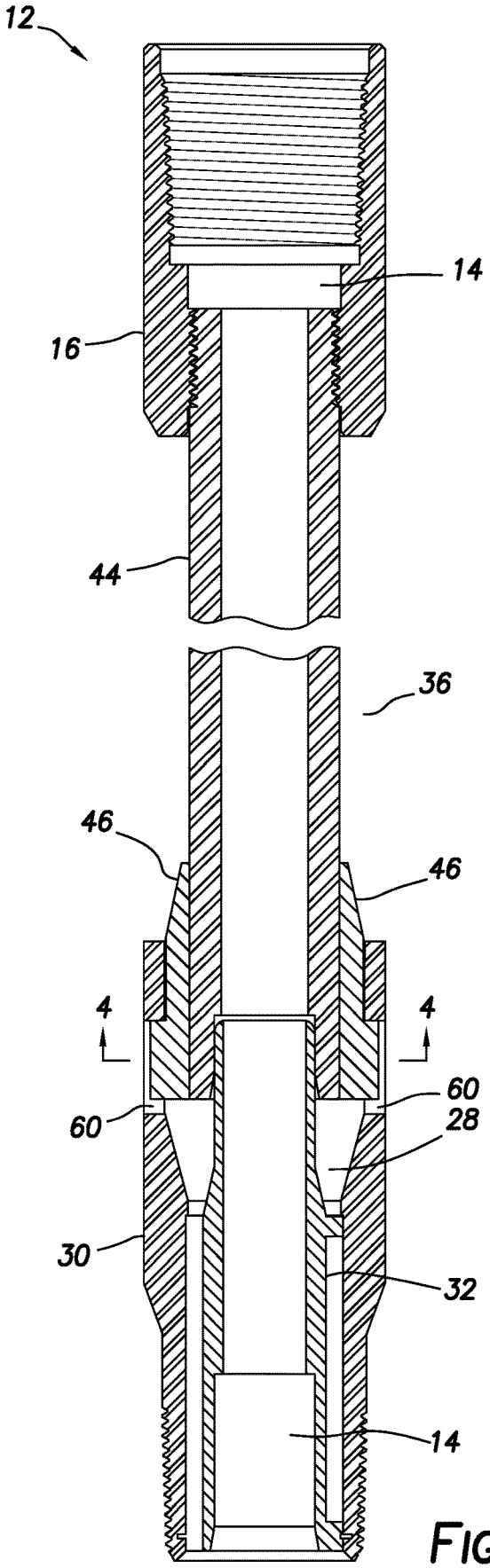
FIG. 3 is a representative cross-sectional view of a gas discharge tool of the FIG. 2 gas separation system.
Figure 4:
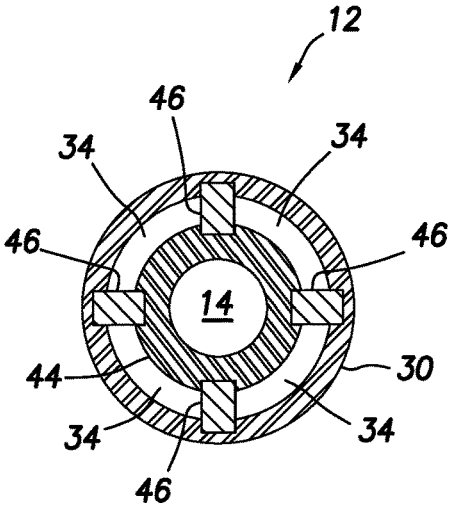
FIG. 4 is a representative cross-sectional view of the gas discharge tool, taken along line 4-4 of FIG. 3.

Referring additionally now to FIGS. 3 & 4, cross-sectional views of the gas discharge tool 12 are depicted apart from the remainder of the system 100. The gas discharge tool 12 can be used with a variety of systems and methods other than the FIG. 1 system 100 and method. FIG. 4 is a lateral cross-sectional view through the connection between the outer housing 30 and the upper tube 44, taken along line 4-4.

Note that the upper neck or tube 44 is connected between the upper connector 16 and the outer housing 30. The tube 44 has a smaller outer diameter than each of the upper connector 16 and the outer housing 30. This radially enlarges the annulus 36 at the discharge ports 34, so that the well fluids 20 can more readily and efficiently exit the tool 12 into the annulus.

The ports 34 are formed radially between the tube 44 and the outer housing 30, and circumferentially between radial spacers 46 that radially separate the tube from the outer housing. In this example, the spacers 46 also serve to connect the tube 44 and the outer housing 30.

The spacers 46 in this example are circumferentially spaced apart and positioned mostly radially between the outer housing 30 and the tube 44. The spacers 46 project radially outward into openings 60 formed through the outer housing 30. The spacers 46 may be attached to the tube 44 using fasteners, welds or other types of attachments. Thus, the spacers 46 are connected between the outer housing 30 and the tube 44, so that tensile and compressive loads, as well as torque, can be transmitted between the outer housing and the tube.

Figure 5:
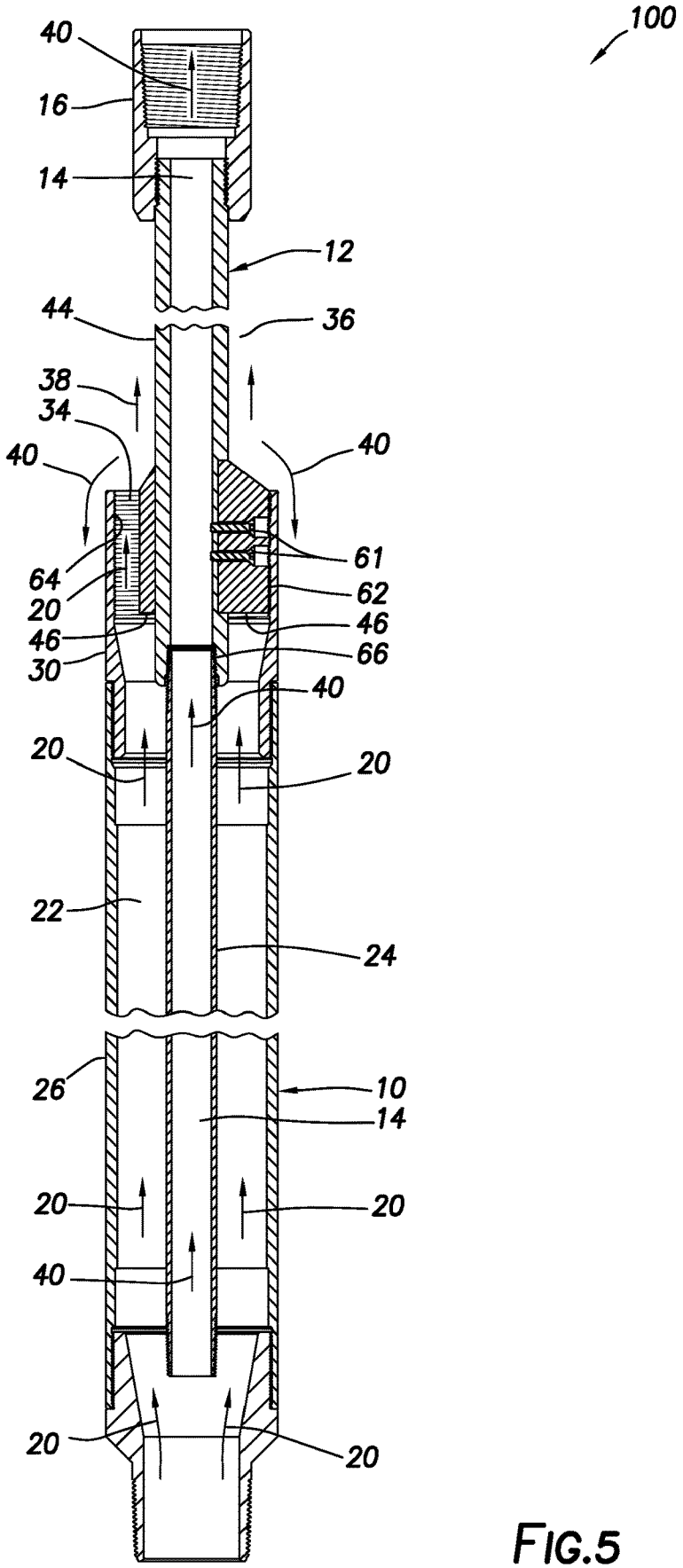
FIG. 5 is a representative cross-sectional view of another example of the upper portion of the gas separation system.

Referring additionally now to FIG. 5, a cross-sectional view of another example of the upper portion of the gas separation system 100 is representatively illustrated. In the FIG. 5 example, the gas discharge tool 12 and the gas separator tool 10 are modified as compared to the FIGS. 2-4 example.

The spacers 46 in the FIG. 5 gas discharge tool 12 example are attached to the tube 44 using fasteners 61. External surfaces of the spacers 46 have threads 62 formed thereon, which engage internal threads 64 formed in an upper end of the outer housing 30. The well fluids 20 exit the discharge ports 34 formed circumferentially between the spacers 46, as in the FIGS. 2-4 example.

As depicted in FIG. 5, the tube 44 of the gas discharge tool 12 is connected directly to the inner tube 24 of the gas separator tool 10 at a threaded connection 66. The flow passage 14 extends through the tube 44 and the inner tube 24 for flow of the liquids 40 to the surface, as in the FIGS. 2-4 example.

It may now be fully appreciated that the above disclosure provides significant improvements to the art of downhole gas/liquid separation. In examples described above, the gas discharge tool 12 is configured to discharge the well fluids 20 upwardly from the discharge ports 34 into the enlarged annulus 36 surrounding the tube 44. The gas 38 is able to flow upward to the surface unimpeded, and the liquids 40 can fall in the annulus 36 to inlet openings 42 of the gas separator tool 10.

The above disclosure provides to the art a gas separation system 100 for use with a subterranean well. In one example, the system 100 can comprise a gas separator tool 10, and a gas discharge tool 12 including an inner flow passage 14 formed through a tube 44 and configured to convey separated liquids 40, and discharge ports 34 configured to discharge well fluids 20 upwardly into an area surrounding the tube 44.

The discharge ports 34 may be formed in an outer housing 30 having an outer diameter which is larger than an outer diameter of the tube 44. The discharge ports 34 may be configured to discharge the well fluids 20 in a direction generally parallel to the tube 44. The discharge ports 34 may be formed radially between the tube 44 and an outer housing 30 of the gas discharge tool 12.

The gas separator tool 10 can include an outer housing 26 having an outer diameter which is larger than an outer diameter of the tube 44. The outer housing 26 may be configured to convey the well fluids 20 upwardly through an annulus 22 formed radially between an inner tube 24 and the outer housing 26. The inner flow passage 14 can extend through the inner tube 24. The annulus 22 may be in fluid communication with the discharge ports 34.

The above disclosure also provides to the art a method of separating gas 38 from liquids 40 of well fluids 20 produced from a subterranean well. In one example, the method can comprise: connecting a gas separator tool 10 and a gas discharge tool 12 to a production tubing string 48; positioning the gas separator tool 10 and the gas discharge tool 12 in the well, so that the well fluids 20 are produced into the gas separator tool 10; receiving the well fluids 20 from the gas separator tool 10 into the gas discharge tool 12; and discharging the well fluids 20 from the gas discharge tool 112 into a radially enlarged section of an annulus 36 surrounding the gas discharge tool 12.

The liquids 40 separated from the well fluids 20 may be flowed to surface via an inner flow passage 14 that extends through a tube 44 of the gas discharge tool 12. The enlarged section of the annulus 36 surrounds the tube 44.

The discharging step may include flowing the well fluids 20 in an upward direction from discharge ports 34 into the enlarged section of the annulus 36.

The method may include forming the discharge ports 34 in an outer housing 30 having an outer diameter which is larger than an outer diameter of a tube 44 of the gas discharge tool 12, and flowing the liquids 40 separated from the well fluids 20 through the tube 44.

The discharging step may include discharging the well fluids 20 in a direction generally parallel to the tube 44.

The forming step may include forming the discharge ports 34 radially between the tube 44 and the outer housing 30.

The method may include flowing the separated liquids 40 into the tube 44 from the annulus 36.

Another gas separation system 100 described above can comprise: a gas separator tool 10 including a first annulus 22 formed radially between a first outer housing 26 and an inner tube 24, and an inner flow passage 14 extending through the inner tube 24, the first annulus 22 being configured to convey well fluids 20 and the inner flow passage 14 being configured to convey liquids 40 separated from the well fluids 20; and a gas discharge tool 12 including discharge ports 34 configured to discharge the well fluids 20 from the first annulus 22 into an enlarged section of a second annulus 36 surrounding the gas discharge tool 12.

The discharge ports 34 may be formed in a second outer housing 30 of the gas discharge tool 12 having an outer diameter which is larger than an inner diameter of the enlarged section of the second annulus 36.

The discharge ports 34 may be configured to discharge the well fluids 20 in a direction generally parallel to a tube 44 of the gas discharge tool 12 through which the inner flow passage 14 extends.

The discharge ports 34 may be formed radially between the tube 44 and a second outer housing 30 of the gas discharge tool 12.

The first outer housing 26 can have an outer diameter which is larger than an outer diameter of the tube 44.

The first annulus 22 may be in fluid communication with the discharge ports 34.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A gas separation system for use with a subterranean well, the system comprising:

a pump;

a gas separator tool; and a gas discharge tool positioned longitudinally between the pump and the gas separator tool, the gas discharge tool including an inner flow passage formed through a tube and configured to convey separated liquids, and the gas discharge tool including upward-facing discharge ports configured to discharge all produced well fluids upwardly into an area surrounding the tube, in which the discharge ports are formed between radial spacers which circumferentially divide an annulus formed radially between the tube and an outer housing of the gas separator tool, whereby each discharge port comprises an annular segment of the annulus, and in which the discharge ports are parallel to a longitudinal axis of the gas discharge tool, whereby all of the produced well fluids flow upwardly in a straight longitudinal direction therethrough.

2. The system of claim 1, in which the radial spacers are configured to connect the tube and the outer housing, whereby tensile and compressive loads, as well as torque, can be transmitted between the outer housing and the tube.

3. The system of claim 1, in which the discharge ports are configured to discharge all of the produced well fluids in a direction generally parallel to the tube.

4. The system of claim 1, in which the discharge ports are formed radially between the tube and the outer housing of the gas discharge tool.

5. The system of claim 1, in which the outer housing has an outer diameter which is larger than an outer diameter of the tube.

6. The system of claim 5, in which the outer housing is configured to convey all of the produced well fluids upwardly through an annulus formed radially between an inner tube and the outer housing, and the inner flow passage extends through the inner tube.

7. The system of claim 6, in which the annulus is in fluid communication with the discharge ports.

8. A method of separating gas from liquids of well fluids produced from a subterranean well, the method comprising:

connecting a gas separator tool and a gas discharge tool to a production tubing string;

positioning the gas separator tool and the gas discharge tool in the well, so that all of the produced well fluids flow into the gas separator tool;

receiving all of the produced well fluids from the gas separator tool into the gas discharge tool; and discharging all of the produced well fluids from the gas discharge tool via upward-facing discharge ports into a radially enlarged section of an annulus surrounding the gas discharge tool, in which the discharge ports are formed between radial spacers which circumferentially divide an annulus formed radially between the tube and an outer housing of the gas separator tool, whereby each discharge port comprises an annular segment of the annulus, and in which the discharge ports are parallel to a longitudinal axis of the gas discharge tool, whereby all of the produced well fluids flow upwardly in a straight longitudinal direction therethrough.

9. The method of claim 8, in which the liquids separated from the well fluids are flowed to surface via an inner flow passage that extends through a tube of the gas discharge tool, and in which the enlarged section of the annulus surrounds the tube.

10. The method of claim 8, in which the radial spacers are configured to connect the tube and the outer housing, whereby tensile and compressive loads, as well as torque, can be transmitted between the outer housing and the tube.

11. The method of claim 8, in which the outer housing has an outer diameter which is larger than an outer diameter of the tube of the gas discharge tool.

12. The method of claim 11, in which the discharging comprises discharging all of the produced well fluids in a direction generally parallel to the tube.

13. The method of claim 11, further comprising flowing the separated liquids into the tube from the annulus.

14. The method of claim 8, in which the discharge ports are formed radially between the tube and the outer housing.

15. A gas separation system for use with a subterranean well, the system comprising:

a gas separator tool including a first annulus formed radially between a first outer housing and an inner tube, and an inner flow passage extending through the inner tube, the first annulus being configured to convey all produced well fluids and the inner flow passage being configured to convey liquids separated from the well fluids; and a gas discharge tool including upward-facing discharge ports configured to discharge all of the produced well fluids from the first annulus into an enlarged section of a second annulus surrounding the gas discharge tool, in which the discharge ports are formed between radial spacers which circumferentially divide a third annulus formed radially between a tube of the gas discharge tool and a second outer housing of the gas discharge tool, whereby each discharge port comprises an annular segment of the third annulus, and in which the discharge ports are parallel to a longitudinal axis of the gas discharge tool, whereby all of the produced well fluids are discharged upwardly in a direction parallel to the tube of the gas discharge tool through which the inner flow passage also extends.

16. The system of claim 15, in which the second outer housing of the gas discharge tool has an outer diameter which is larger than an inner diameter of the enlarged section of the second annulus.

17. The system of claim 15, in which the discharge ports are formed radially between the tube and the second outer housing of the gas discharge tool.

18. The system of claim 15, in which the first outer housing has an outer diameter which is larger than an outer diameter of the tube.

19. The system of claim 15, in which the first annulus is in fluid communication with the discharge ports.

20. The system of claim 15, in which the radial spacers are configured to connect the tube and the second outer housing of the gas discharge tool, whereby tensile and compressive loads, as well as torque, can be transmitted between the second outer housing and the tube.

* * * * *